US005782691A

United States Patent [19]

Stewart

[11] Patent Number: 5,782,691

[45] Date of Patent: Jul. 21, 1998

[54] MAILABLE MULTI-SHEET BUSINESS FORM FOR PREVENTION OF TENTING DURING PRINTING

[76] Inventor: Gary E. Stewart, 2405 E. Desert Crest, Paradise Valley, Ariz. 85253

[21] Appl. No.: 543,368

[22] Filed: Oct. 16, 1995

Related U.S. Application Data

[63] Continuation-in-part of Ser. No. 423,313, Apr. 18, 1995, Pat. No. 5,630,627, which is a continuation-in-part of Ser. No. 408,887, Mar. 24, 1995, Pat. No. 5,637,369, which is a continuation-in-part of Ser. No. 246,966, May 20, 1994, Pat. No. 5,482,328.

[51] Int. Cl.[6] ..... B42D 15/00; B41L 1/26

[52] U.S. Cl. ..... 462/4; 462/2; 462/8; 462/12

[58] Field of Search ..... 462/2–5, 7, 8, 462/10, 11, 25, 26, 27, 32, 33, 36–38, 64–66, 84, 900, 901, 12; 281/2, 5; 283/61, 62, 116; 229/69, 301; 428/43

[56] References Cited

U.S. PATENT DOCUMENTS

| | | | |
|---|---|---|---|
| 3,065,979 | 11/1962 | Steidinger | 462/4 X |
| 3,066,957 | 12/1962 | Huffman | 462/4 |
| 3,092,401 | 6/1963 | Steidinger | 462/4 |
| 3,820,447 | 6/1974 | Gendron et al. | 462/6 X |
| 3,837,565 | 9/1974 | Johnsen | 462/6 X |
| 4,108,352 | 8/1978 | Peschke | 462/4 X |
| 4,123,086 | 10/1978 | French | 462/5 |
| 4,361,269 | 11/1982 | Neubauer | 229/69 |
| 4,375,382 | 3/1983 | Steidinger | 229/69 X |
| 4,461,661 | 7/1984 | Fabel | 229/69 X |
| 4,475,747 | 10/1984 | Ashby | 462/6 |
| 4,529,227 | 7/1985 | Fields | 462/5 |
| 4,705,297 | 11/1987 | Wakeman | 462/5 X |
| 4,728,027 | 3/1988 | Steidinger | 229/69 |
| 4,770,337 | 9/1988 | Leibe | 229/69 |
| 4,896,822 | 1/1990 | Ashby | 229/69 |
| 5,038,999 | 8/1991 | Dicker | 462/4 X |
| 5,183,203 | 2/1993 | Sanders | 462/6 X |
| 5,183,436 | 2/1993 | Shanley | 462/6 |
| 5,393,264 | 2/1995 | Kraft et al. | 462/6 |
| 5,413,383 | 5/1995 | Laurash et al. | 462/6 X |
| 5,427,416 | 6/1995 | Birch | 462/6 X |

*Primary Examiner*—Frances Han
*Attorney, Agent, or Firm*—Tod R. Nissle, P.C.

[57] ABSTRACT

A strip of multi-part business forms includes a plurality of primary sheets and secondary sheet each attached to a primary sheet. The primary sheets are separated by and folded along lines of weakening formed in the strip. Each secondary sheet is removable from a primary sheet to reveal a die cut and/or imprinted area on the primary sheet. The construction of the strip of business forms avoids tenting problems which are encountered by conventional strips of multi-part business forms.

4 Claims, 8 Drawing Sheets

FIG. 1
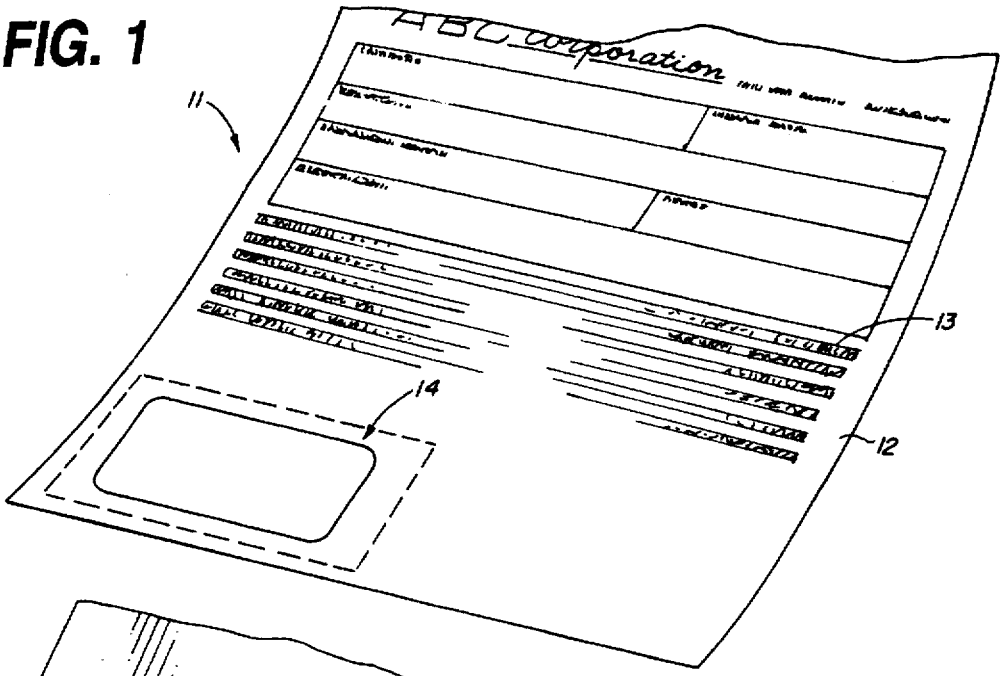
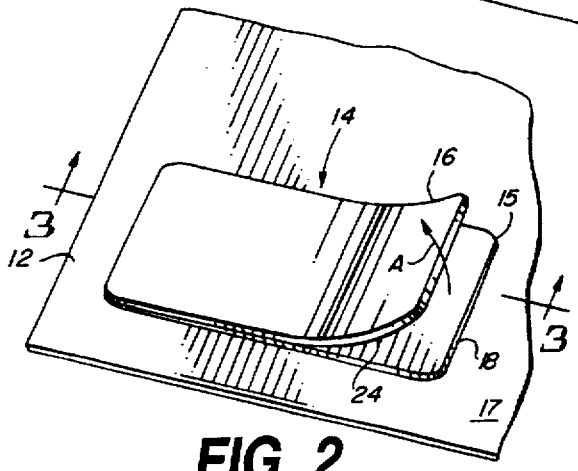
FIG. 2
(PRIOR ART)
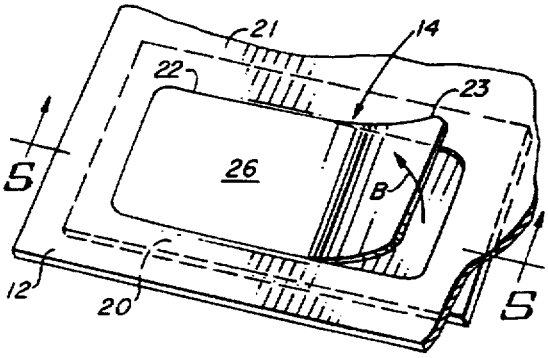
FIG. 4
(PRIOR ART)
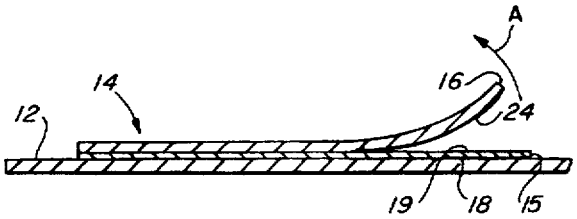
FIG. 3
(PRIOR ART)
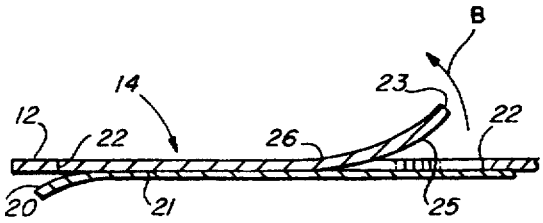
FIG. 5
(PRIOR ART)

MAILABLE MULTI-SHEET BUSINESS FORM FOR PREVENTION OF TENTING DURING PRINTING

This application is a continuation-in-part of application Ser. No. 08/423,313, filed Apr. 18, 1995, now U.S. Pat. No. 5,630,627, which is a continuation-in-part of application Ser. No. 08/408,887, filed Mar. 24, 1995, now U.S. Pat. No. 5,637,369, which is a continuation-in-part of application Ser. No. 08/246,966, filed May 20, 1994, now U.S. Pat. No. 5,482,328.

This invention relates to business forms having die cut label areas which are removable therefrom and to a method for producing the same.

More particularly, the invention pertains to a business form which includes an imprinted paper substrate having label stock affixed thereto, the label stock including a layer of face stock permanently adhesively secured to the back of the substrate and a liner layer adhesively secured to the back of the face stock layer such when the liner layer is peeled off of the face stock layer, a layer of adhesive remains affixed to the back of the face stock layer.

In a further respect, the invention pertains to a business form of the type described which includes a multi-layer removable die cut area which extends through the paper substrate and the face stock layer such that the die cut area can be peeled off of the liner layer and removed from the business form.

In another respect, the invention relates to a multiple layer business form which minimizes tenting in order to facilitate the imprinting and folding of the business form, which can be mailed, and which is readily opened by the recipient of the mailed form.

As described in my U.S. Pat. No. 4,379,573, providing business forms with removable labels is a widespread practice. Such labels are often imprinted with information which, when combined with the ability to transfer the label, facilitates the completion of a particular business transaction. For instance, a label may be imprinted with the name and address of the company from which the business form originated so that a customer can remove the label from the form and then attach the label to an envelope containing an order being forwarded to the company. Likewise, the label may be imprinted with information identifying the customer so that when the label is attached to an order form processing of the order by the company is expedited.

These so-called "transfer labels" are actually comprised of two layers of material. The first or lower layer has a pressure sensitive adhesive on its bottom surface and an adhesive on its upper surface which detachably secures the second layer —a paper label —thereto. Transfer labels are normally applied to business forms by feeding the forms into a label air machine which blows the transfer labels from a strip of carrier material toward the forms so that the pressure sensitive adhesive on the bottom surface of each label contacts and adheres to one of the forms.

In many paper manufacturing operations, such as the printing and assembly of business forms, it is common practice to carry out the operation in a series of repetitive steps at spaced points along a continuously moving strip of paper and to then cut the continuous strip into the size required to form the pages of the business form. In particular, multi-part business forms are printed and collated in such a fashion and the collated continuous strips of paper are cut into the desired size after the final assembly thereof.

In this regard, the principal disadvantage of the conventional label air machine described above is that, in order to apply the transfer labels, business forms cannot be continuously passed through the machine but must essentially be indexed through the machine one at a time. The usual practice for applying transfer labels to a continuous strip of business forms is to fold the strip in zig-zag fashion along transverse lines of weakening formed in the paper and to then feed the stack of folded paper into the label air machine. Operation of the label air machine requires that each individual form in the stack of folded paper be indexed through the label air machine; i.e., the paper does not continuously move as it passes through the machine, rather, one segment of paper is pulled into the machine, the movement of paper momentarily stops while a label is applied, and then another segment of paper is indexed into the machine. It has become a common industry practice to feed stacks of folded paper into the machine instead of pulling the paper from a roll thereof because the first sheet in a stack can be glued or attached to the final sheet of the stack of paper being fed into the machine. This permits the label air machine to be run continuously. If paper was fed into the machine from a roll, the machine would have to be shut down when the end of a roll was reached so that the core of the old roll could be removed and a new roll installed on the machine.

A further limitation of the label air machine is that the machine is unable to accurately apply labels in the same position on identical business forms. The comparative position of labels blown onto identical business forms by the machine will often vary by about 1/16 of an inch. The variance in the positioning of labels precludes imprinting the entire surface of the label and, as a consequence, the material to be printed thereon will normally occupy an area substantially less than the surface area of the label to compensate for variance in label position. The inability of the label air machine to consistently place a label in the same position on identical business forms results in a substantial amount of unused and wasted label material.

The conventional label air machine is further limited in operation in that when a plurality of transfer labels or strips are attached side by side to a paper substrate, there must be a minimum distance of approximately two inches between any two labels. This particular limitation rules out the application of a pair of closely spaced labels to a paper substrate.

The printing of business forms is commonly carried out by feeding continuous strips of business forms through high-speed presses at the rate of thousands of copies per hour. Prior to the improved process described and claimed in my U.S. Pat. No. 4,379,573, a like process which permitted both the imprinting of a paper substrate and formation of a removable label on the substrate is a "one-pass" continuous high speed operation apparently had not been utilized. Instead, the conventional process comprised imprinting a continuous strip of paper substrate, folding the strip, running a stack of folded paper through a label air machine to attach the labels, refolding or rolling the continuous strip of labeled paper leaving the label air machine, and then collating, cutting or further imprinting the continuous strips as desired. This conventional process obviously entails repeated manual handling of the paper and the increased production costs associated therewith.

Even assuming that a conventional label air machine were able to be employed in an automated process, three to five percent of the business forms processed by the machine would not be usable because the applied labels would be bent, would be damaged, or would have failed to adhere to the paper when blown on. In addition, the bi-layered transfer labels employed generally have an average thickness of seven to eight thousandths of an inch. When large numbers of label forms are stacked, the resulting buildup of label thickness can, especially when a single label is applied to each form, cause the paper stack to list, making handling and storage of the paper awkward.

The prior art transfer tape —die cut label process and business form described in my U.S. Pat. No. 4,379,573 was developed to overcome some of the above-described problems associated with the conventional label air machine. This transfer tape —die cut label process permits a continuously moving paper substrate to be imprinted and provided with a removable label during a single pass through paper processing equipment. During the transfer tape —die cut process, the contact adhesive on a piece of transfer tape is pressed against the back of a business form to secure the tape to the form. A die cut label area is then made in the form above the transfer tape. The die cut label can be peeled off of the form. When the die cut label is peeled off of the form, the adhesive on the transfer tape "transfers" from the transfer tape to the back of the label so that the label can be adhered to an envelope or other desired surface. The transfer tape —die cut label process described and claimed in my U.S. Pat. No. 4,379,573 is advantageous because it permits a continuously moving paper substrate to be imprinted and provided with a removable label during a single pass through paper processing equipment, because it can add only a small amount of additional thickness to a business form so that the build-up of label thickness is minimized when forms having the transfer tape are processed, and because the process minimizes the number of defective and unusable business forms after paper substrates have been imprinted and provided with transfer tape and removable die cut label areas.

The transfer tape —die cut process does, however, have certain disadvantages. First, the cost of transfer tape is relatively expensive, about fifty cents per one thousand square inches. Second, the use of transfer tape inherently limits the type of adhesives which can be utilized because the tape requires adhesives which will separate from the tape and "transfer" to a second surface which is pressed against the adhesive. Third, the selection of transfer tape is limited. Only certain sizes of transfer tape are available. Fourth, transfer tape is difficult to use on business form substrates which are thin. Even though the adhesive from transfer tape which sticks to the back of a die cut business form label tends to "thicken" the label, light weight paper simply does not make particularly good labels because light weight paper readily tears and wrinkles.

Another problem encountered in the prior art concerns multiple sheet business forms. The manufacture of multi-sheet business forms typically includes the steps of superimposing strips of paper (or other material) of equal width and length one on top of the other to form a multi-layer web. Parallel, spaced apart transverse lines of weakening or perforation are formed along the web. Each business form and the multiple sheets comprising the business form are bounded by a successive pair of the transverse lines of weakening formed in the web. Imprinting or folding a multi-layer business form is difficult because when the web is folded or travels around a cylinder the outer strip of paper in the web must travel a longer distance than the inner paper strip, in which case the outer strip tends to tear free along the lines of weakening. Elaborate equipment and gluing schemes have been developed in an attempt to combat this problem.

Accordingly, it would be highly desirable to provide an improved removable label business form which would incorporate the advantages of the transfer tape —die cut process while significantly reducing cost, while permitting the use of a wide variety of adhesives, while providing a wide selection of materials which can be used in combination with a business form to produce a removable label, and while enabling light weight business forms to be provided with removable labels.

It would also be highly desirable to provide an improved strip of multi-sheet business forms which would minimize tenting and facilitate the imprinting and folding of the business form.

It would further be highly desirable to provide an improved multi-sheet business form which could be imprinted for mailing and could be opened to reveal an imprinted or die-cut portion that is concealed in the business form during its transport by the postal service.

Therefore, it is a principal object of the invention to provide an improved business form having a label or labels removable therefrom.

Another object of the invention is to provide a method for imprinting and providing a removable label for a business form which allows a continuously moving paper substrate to be imprinted and provided with a removable label during a single pass through paper processing equipment.

A further object of the present invention is to provide a method for providing a paper sheet substrate with a removable label which reduces cost, which permits the use of a wide variety of adhesives, which enables a wide selection of convention, off-the-shelf, readily available materials to be used in combination with a business form to produce a removable label, and which enables business forms made from light weight paper to be provided with removable labels.

Still another object of the invention is to provide a method for imprinting and providing a paper sheet substrate with a removable label which results in a minimal number of defective and unusable business forms after the substrate has been imprinted and provided with removable label areas.

Yet another object of the invention is to provide a method for producing business forms which permits a removable label to be accurately placed in an identical position on each of a plurality of forms.

Yet still another object of the invention is to provide an improved multi-part business form which does not encounter tenting problems when the business form is folded or moves around the platen in a printing press.

These and other, further and more specific objects and advantages of the invention will be apparent to those skilled in the art from the following detailed description thereof, taken in conjunction with the drawings, in which:

FIG. 1 is a perspective view of a business form provided with a removable label;

FIG. 2 is a partial perspective view of the business form of FIG. 1 illustrating a prior art removable label attached thereto;

FIG. 3 is a sectional view of the business form of FIG. 2 taken along section line 3—3 thereof;

FIG. 4 is a partial perspective view of the business form of FIG. 1 illustrating another prior art removable label attached thereto;

FIG. 5 is a sectional view of the business form of FIG. 4 taken along section line 5—5 thereof;

Figure 6:
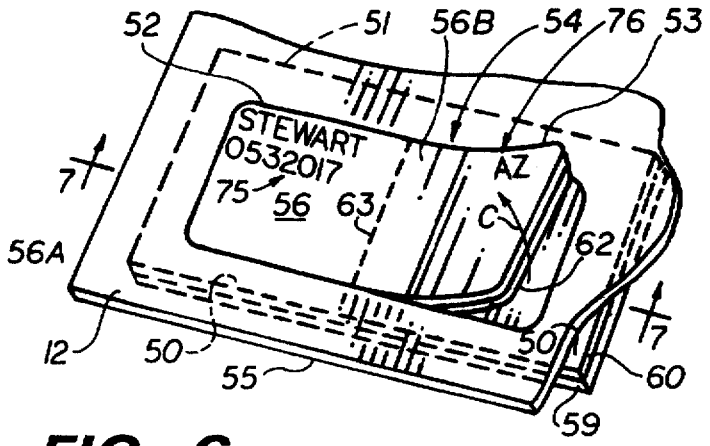
FIG. 6 is a section view of the business form of FIG. 1 provided with a removable label in accordance with one embodiment of the present invention.

Briefly, in accordance with the invention, I provide a business form having a die cut label area removable therefrom. The form includes a sheet of paper having a back side, an imprinted front side and an outer peripheral edge; and, at least one piece of label stock.

The label stock has an outer peripheral edge and includes a layer of face stock, a layer of liner material, and a first layer of adhesive intermediate the layer of face stock and the layer of liner material. The layer of adhesive adheres to the face stock and separates from the layer of liner material when the face stock is peeled away from the liner material.

A second layer of adhesive fixedly secures the label stock to a limited area on the back of the paper sheet such that the outer peripheral edge of the piece of label stock generally lies within the outer peripheral edge of the paper sheet.

A label area is die cut in the sheet of paper above the layer of liner material and has an outer peripheral edge. The outer peripheral edge of the die cut label generally lies within the outer peripheral edge of the label stock.

A label backing is die cut in the face stock of the label stock above the layer of liner material and has an outer peripheral edge coterminating with the outer peripheral edge of the label area.

A portion of the first layer of adhesive lying between the layer of liner material and the die cut label backing adheres to the label backing and separates from the layer of liner material when the label backing is peeled away from the layer of liner material.

A portion of the business form lies between the peripheral edge of the die cut label area and the peripheral edge of the transfer tape and includes a first portion of the second layer of adhesive sandwiched between a section of the sheet of paper and a section of the layer of face stock of the label stock lying outside the outer peripheral edge of the label area.

A second portion of the second layer of adhesive lies between the label area and the label backing, and adheres the label area to the label backing when the label backing is peeled away from the liner material.

The label stock is sized such that the first portion of the second layer of adhesive in the portion of the business form between the peripheral edge of the die cut label area and the peripheral edges of the label stock is sufficient to maintain the portion of the layer of face stock lying outside the outer peripheral edge of the label area in position on the paper sheet when the label backing is peeled from the backing material of the label stock.

In another embodiment of the invention, I provide a strip of paper including a plurality of business forms attached end-to-end along transverse parallel lines of weakening. Each of the business forms includes a first leaf having a front side, a back side, a width, a height, an outer peripheral edge, and an imprinted area lying within the outer peripheral edge; a second leaf having a front side, a back side, a width, a height, and an outer peripheral edge, the height of the second leaf being less than the height of the first leaf, the second leaf lying within the outer peripheral edge of the first leaf; and, adhesive or other fastening means for releasibly securing at least a portion of the outer peripheral edge of the second leaf to the front side of the first leaf such that (1) the imprinted area lies within the outer peripheral edge of the second leaf and is covered by said second leaf, and (2) the second leaf can be peeled off of the first leaf to expose the imprinted area.

In a further embodiment of my invention, I provide a strip of paper including a plurality of business forms attached end-to-end along transverse parallel lines of weakening. Each of the business forms includes a first leaf having a front side, a back side, a width, a height extending from one of the lines of weakening to the next successive line of weakening, an outer peripheral edge, and an imprinted area lying within the outer peripheral edge, the one of the lines of weakening and the next successive line of weakening bounding the first leaf; a second leaf having a front side, a back side, a width, a height, and an outer peripheral edge, the height of the second leaf being less than the height of the first leaf; and, adhesive or other fastening means for securing at least a portion of the outer peripheral edge of the second leaf to the front side of the first leaf such that (1) the imprinted area lies within the outer peripheral edge of second leaf and is covered by the second leaf, and the second leaf is spaced apart from the one of the lines of weakening and from the next successive line of weakening bounding the first leaf.

In still another embodiment of the invention, I provide a strip of paper including a plurality of business forms attached end-to-end along transverse parallel lines of weakening. Each of the business forms includes a first leaf having a front side, a back side, a width, a height extending from one of the lines of weakening to the next successive line of weakening, an outer peripheral edge, and a die cut area lying within the outer peripheral edge, the one of the lines of weakening and the next successive line of weakening bounding the first leaf; a second leaf having a front side, a back side, a width, a height, and an outer peripheral edge, the height of the second leaf being less than the height of the first leaf; and, means for securing at least a portion of the outer peripheral edge of the second leaf to the front side of the first leaf such that (1) the die cut area lies within the outer peripheral edge of the second leaf and is covered by the second leaf, and (2) the second leaf is spaced apart from the one of the lines of weakening and from the next successive line of weakening bounding the first leaf.

Turning now to the drawings, which describe the presently preferred embodiments of the invention for the purpose of illustrating the practice thereof and not by way of limitation of the scope of the invention, and in which like reference characters refer to corresponding elements throughout the several views, FIG. 1 illustrates a business form generally identified by reference character 11 and consisting of a paper substrate 12 having printed matter 13 and a removable label 14 on the face thereof.

As shown in FIGS. 2 and 3, in one prior art business form, removable label 14 normally consists of two layers 15, 16. The bottom surface 18 of layer 15 has a pressure sensitive adhesive contacting the upper face 17 of substrate 12. The upper surface 19 of layer 15 is provided with an adhesive which removably secures layer 16 thereto. When layer 16 is peeled from layer 15 in the direction of arrow A to form a label, adhesive on the lower surface 24 of layer 16 permits layer 16 to be affixed to another paper form. The combined thickness of layers 15 and 16 is approximately seven to eight thousandths of an inch.

A label 14 formed in substrate 12 in accordance with another prior art business form is illustrated in FIGS. 4 and 5. Upper surface 20 of layer 21 is provided with adhesive which transfers from layer 21 to the bottom surface 25 of substrate 12 when layer 21 is attached thereto. After layer 21 is adhesively secured to substrate 12 the substrate 12 is die cut along line 22 to form label 23 which is peelable from layer 21 in the direction of arrow B. Label 23 may, due to adhesive transferred thereto from layer 21, be secured to an ancillary piece of paper. Layer 21 has a thickness of approximately three thousandths of an inch.

Figure 8:
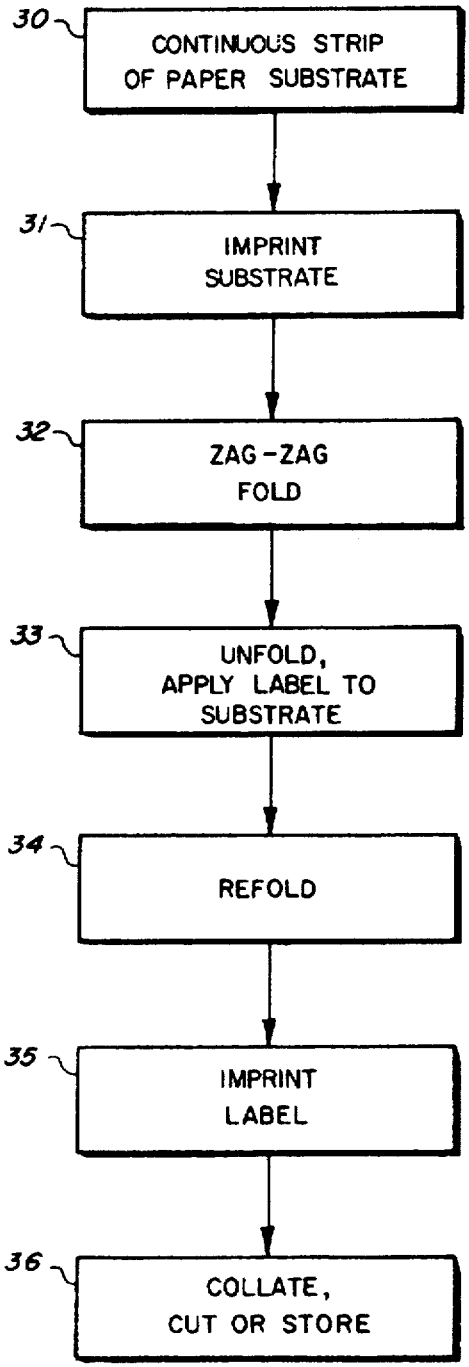
FIG. 8 (PRIOR ART)
FIG. 8 is a flow diagram illustrating a prior art method of producing the business form of FIGS. 1, 2, and 3.

A conventional prior art process for producing the business form of FIGS. 1, 2, 3 is illustrated by the flow chart of FIG. 8. A continuous strip of paper substrate 30 is imprinted with a business format 31 and folded 32 in zig-zag fashion along transverse lines of weakening formed therein. The business forms contained in the stack of folded paper are indexed one at a time through a label air machine which applies the labels 14 of FIGS. 2 and 3 to the paper substrate 12 of form 11. Labeled forms dispensed by the label air machine are refolded 34. The stack of refolded business forms is run through a press to imprint 35 data on removable labels 14. The finished business forms are collated with another strip of paper substrate or carbon paper, are cut, or are stored as desired. Application of labels 14 by the label air machine is a relatively slow process, and the necessity of folding a strip of continuous forms before and after processing by the label air machine creates a bottleneck in the overall process of producing business forms 11 having removable labels 14.

Figure 9:
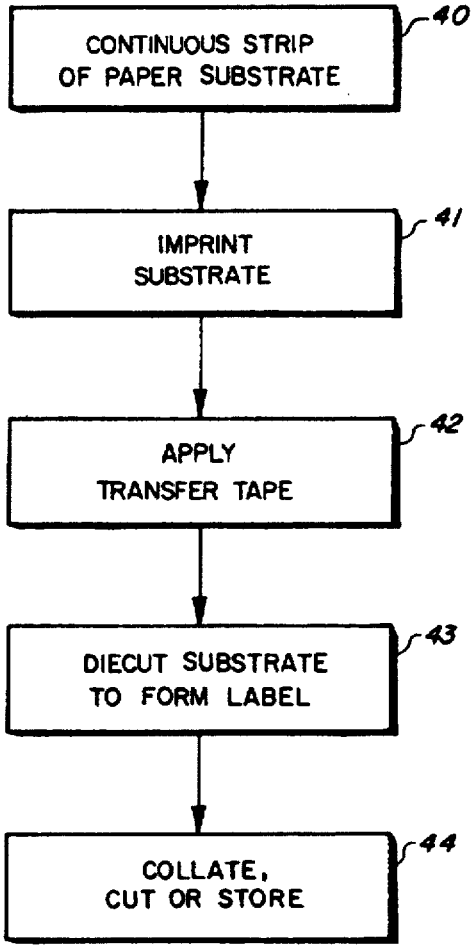
FIG. 9 (PRIOR ART)
FIG. 9 is a flow diagram illustrating a prior art method of producing the business form of FIGS. 1, 4, and 5.

The process illustrated in FIG. 9 allows paper substrate from a supply of individual sheets or of a continuous strip thereof to both be imprinted with a business format and be provided with removable labels during a single pass through paper processing apparatus. In the process of FIG. 9, paper substrate 40 from a continuous supply thereof is imprinted 41 with a business format. Transfer tape is adhesively applied 42 to the paper substrate 12 to form bi-layer areas along the substrate comprising an area of transfer tape adhesively secured to an equivalent adjacent area of the original paper substrate. One of the pair of layers is die cut 43 to form label area which is peelable from the adjacent layer. Since the steps of imprinting 41, die cutting 43 and applying transfer tape 42 can each be carried out on a rapidly moving sheet of paper, the entire process of imprinting and providing a removable label for a paper substrate is completed during a single pass of the substrate through high speed paper processing apparatus. The step of imprinting 41 the substrate may, of course, be performed after application of the transfer tape or after the substrate is die cut.

A variety of transfer tapes 21 may be applied to substrate 12 during the process shown in FIG. 9. In one embodiment of the process of FIG. 9, surface 20 of tape 21 is provided with an adhesive which adheres to surface 12 and separates from the upper surface 20 of tape 21 when label 23 is peeled off in the direction of arrow B (see FIG. 5). However, the lower surface 25 of substrate 12 can be provided with a smooth surface of hardened adhesive which becomes tacky on contact with water. In this case, the adhesive on surface 20 continues to adhere to tape 21 when label 23 is removed. In some instances it is also be desirable for the surface 20 of transfer tape 21 to have a self-contained carbonless coating which reproduces information imprinted on the upper surface of label 23.

Removable labels similar to the labels pictured in FIGS. 2 and 3 can be attached by a label air machine to the same position on a plurality of business forms only to within a variance of about 1/16 of an inch. In contrast, when the process of FIG. 9 is utilized, labels can be die cut at an identical position on a plurality of forms with a variance in position which is substantially less. The improved accuracy of label placement inherent in die cutting the label allows a larger area of the label surface to be imprinted, reducing the amount of transfer tape material required.

A further benefit of the process of FIG. 9 is that when layer 12 is die cut to form removable label area, if a plurality of labels are cut in layer 12, the labels may be closely adjacent one another. There is no minimum spacing requirement similar to that earlier described in the label air machine. In addition, the number of defective and unusable business forms produced during the process of FIG. 9 is less than the accepted industry standard of 3% to 5% of total production for the label air machine.

Figure 7:
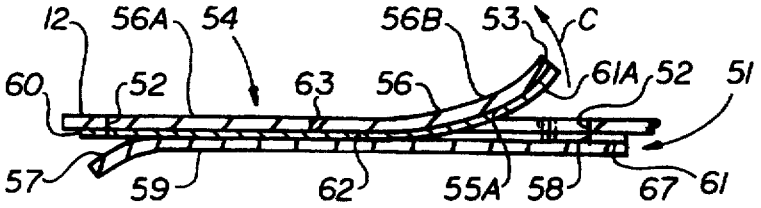
FIG. 7 is a sectional view of the business form of FIG. 6 taken along section line 7—7 thereof.

A removable label 54 formed in substrate 12 in accordance with one embodiment of the invention is illustrated in FIGS. 6 and 7. Conventional label stock 51 is utilized in conjunction with substrate 12 to form label 54. In FIGS. 6 and 7, stock 51 is rectangular and includes a face layer 60 which ordinarily would, in use, be imprinted with alphanumeric characters or other desired inscriptions. A layer of contact adhesive is applied and is affixed to the entire bottom surface 61 of layer 60. A layer 59 of liner material covers bottom surface 61 and the contact adhesive secured thereto such that layer 60 can be peeled apart from liner layer 59 with the contact adhesive still adhering to bottom surface 61. In normal use, the contact adhesive is used to secure the face layer 60 another piece of paper or to another desired surface after layer 60 is peeled apart from liner layer 59.

If desired, label stock 51 can include face layer 60 and liner layer 59 and can, instead of the contact adhesive affixed to surface 61, include an adhesive on upper surface 57 of liner layer 59 which transfers from liner layer 59 to surface 61 of face layer 60 when layer 60 is peeled apart from liner layer 59.

The conventional label stock 51 is attached to the bottom surface 55 of substrate 12 with adhesive which secures upper surface 50 of layer 60 to the bottom surface 55 of substrate 12 when layer 60 is pressed against surface 55 in the manner shown in FIGS. 6 and 7. The layer of adhesive is normally between surface 55 and the upper surface 50 of face layer 60 and is coextensive with layer 60. The adhesive preferably, although not necessarily, permanently affixes layer 60 to bottom surface 55.

After layer 60 is adhesively permanently secured to substrate 12, the substrate 12 and layer 60 are die cut through along continuous peripheral surfaces 52 and 58, respectively, to form a bi-layer label 54 which is peelable from layer 59 and form 11 in the direction of arrow C. Label 54 includes rectangular layer 56 cut from substrate 12 and rectangular backing layer 62 cut from the face layer 60 of label stock 51. Layer 56 has a bottom surface 55A which comprises a portion of the total area of the bottom surface 55 of substrate 12. Layer 56 also has an upper surface having left hand portion 56A and right hand portion 56B. Alphanumeric characters 75 (i.e., "STEWART 0532017") are imprinted or formed on portion 56A, and alphanumeric characters 76 ("AZ") are formed on portion 56B. A line of weakening, for example a perforated line, 63 is formed through layer 56 to facilitate the folding of label 54 in the manner illustrated in FIGS. 11 to 13. Alphanumeric characters 75 and 76 or other characters, pictorial information, or other information or designs can be imprinted on substrate 12 by a laser printer, a stamp, or any other imprinting means in black ink or in any color ink or inks prior to or after substrate 12 is die cut through along surface 52, and prior to layer 56 being peeled from layer 59 and removed from substrate 12.

Backing layer 62 has a bottom surface 61A which comprises a portion of the total area of the bottom surface 61 of the face layer 60. Layer 56 is permanently secured to backing layer 62 by the adhesive noted above to secure layer 60 to the bottom of substrate 12. Liner layer 59 ordinarily is not cut through, at least not completely through such that a tri-layer label can fall free from the business form 11. The tri-layer label would include layers 56, 62, and a portion of liner layer 59 which has a peripheral edge coterminating with the peripheral edges of layers 56 and 62 can. The peripheral edge of layer 56 normally coterminates with the peripheral edge of backing layer 62 and layers 56 and 62 are of equal shape and dimension. It is, however, possible that the peripheral edge of layer 62 could lie within the peripheral edge of layer 56.

After label 54 is peeled off of liner layer 59 and separated from business form 11, label 54 can, due to adhesive carried on the bottom 61A of layer 62, be secured to an ancillary piece of paper, a shipping container, or any other desired article. When label 54 is peeled off of liner layer 59, liner layer 59 and remaining portions of face layer 60 remain affixed to substrate 12 in the manner illustrated in FIGS. 4 and 5.

Figure 11:
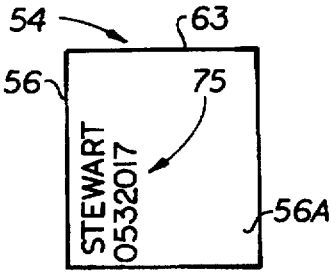
FIG. 11 is a side view illustrating a card produced by folding in half the label of FIGS. 6 and 7.
Figure 12:
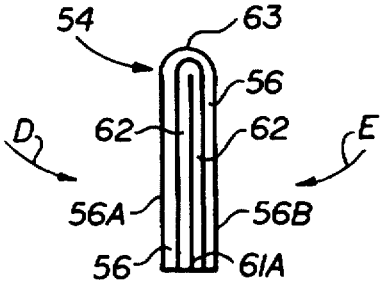
FIG. 12 is a front view further illustrating the card of FIG. 11.
Figure 13:
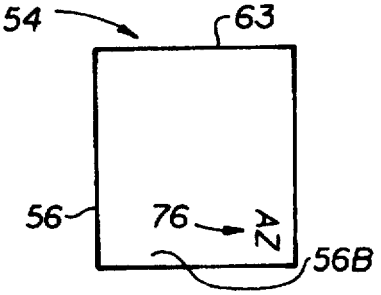
FIG. 13 is a side view further illustrating the card of FIG. 12.

After label 54 is peeled off of liner layer 59 and separated from business form 11, label 54 can also, due to the adhesive carried on the bottom 61A of layer 62, be folded in half along line of weakening 63 in the directions indicated by arrows D and E in FIG. 12 to take on the configuration shown in FIG. 12. In FIGS. 11 to 13, the adhesive on the bottom 61A of layer 62 secures both halves of label 54 together when the bottom 61A is folded along line of weakening 63 such that each half of bottom 61A is pressed against the other half to take on the configuration shown in FIGS. 11 to 13.

The card or laminate illustrated in FIGS. 11 to 13 is advantageous because the alphanumeric characters 75, 76 or other information or data or illustrations appearing on the "front" surface 56A and "back" surface 56B of the card can be pre-printed or otherwise formed on a business form or substrate 12 prior to peeling label 54 from the form in the manner illustrated in FIG. 6. Consequently, a card or other laminate can be formed without requiring a first printing pass to imprint the front of the card and requiring a second printing pass to imprint the back of the card.

The thickness of face layer 60 of the label stock 51 can vary as desired, as can the shape and dimension of label stock 51. Stock 51 can be rectangular, square, circular, or any other shape and dimension. The thickness of backing layer 62 (and face stock 60) can vary widely because of the wide availability of differing types of label stock. A particular virtue of the method of the invention is that it permits a business form 11 to be produced utilizing a paper substrate 12 having an unusually light weight of ten to twelve pounds. This is possible because the layer 62 increases the thickness, weight, and strength of the label 54 produced in conjunction with substrate 12. Being able to utilize a light weight substrate 12 in the production of the business form 11 of the invention is important because it can significantly reduce the cost of the substrate used to produce form 11. This cost savings is further enhanced by the fact that label stock only costs about 30 cents per 1000 square inches, compared to about 50 cents per 1000 square inches for transfer tape. Further, the adhesive used to affix surface 50 to the back of substrate 12 can be any of a wide variety adhesives and is not restricted to the specialty adhesives associated with the production of transfer tape.

Figure 10:
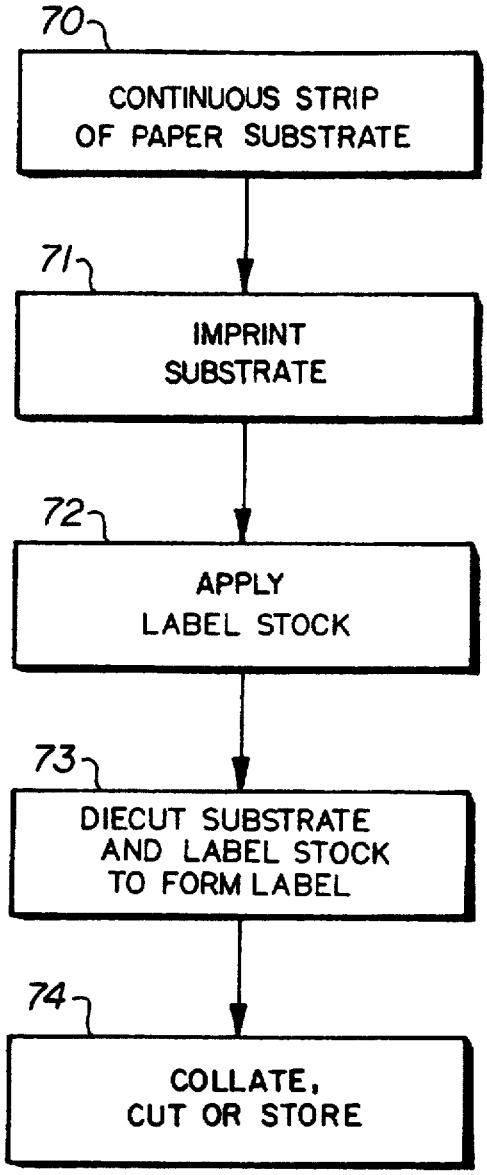
FIG. 10 is a flow diagram illustrating a process for producing a business form having a removable label in accordance with the instant invention.

The process utilized to produce the business form label of FIGS. 6 and 7 is illustrated in FIG. 10. In the process of FIG. 10, paper substrate 70 from a continuous supply thereof is imprinted 71 with a business format. Label stock is adhesively applied 72 to an equivalent adjacent area of the bottom of paper substrate 12 to form a tri-layer area on the substrate. A portion of the substrate adjacent the label stock comprises the first layer. The label stock comprises second and third layers, a face layer and a liner layer. The face layer (second layer) is sandwiched between the substrate layer (first layer) and the liner layer (third layer). The substrate layer and face layers are die cut 73 to form label area which is peelable from the adjacent liner layer. Since the steps of imprinting 71, applying label stock 72, and die cutting 73 can each be carried out on a rapidly moving sheet of paper, the entire process of imprinting and providing a removable label for a paper substrate is completed during a single pass of the substrate through high speed paper processing apparatus. The step of imprinting 71 the substrate may, of course, be performed after application of the label stock or after the substrate and face layer of the label stock are die cut. In some instances it is desirable for the surface of liner layer 59 to have a self-contained carbonless image which reproduces information imprinted on the upper surface of layer 56 before the label area 54 is peeled off of liner layer 59.

The lower surface 61 (and consequently surface 61A) of face layer 60 can be provided with a smooth surface of hardened adhesive which becomes tacky on contact with water. In this case, surface 57 is provided with another layer of adhesive which continues to adhere to surface 57 and liner layer 59 when label 54 is removed from business form 11 by peeling label 54 off of liner layer 59. Label 54 includes peripheral edge 53.

Figure 14:
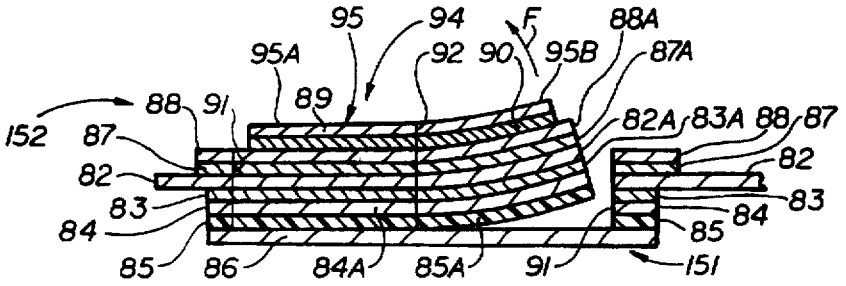
FIG. 14 is a side section view illustrating an alternate embodiment of the invention.

Another embodiment of the invention is illustrated in FIGS. 14 to 17. A removable label 94 is formed in substrate or business form 82. Conventional label stock 151 is utilized in conjunction with substrate 82 to form label 94. Label stock 151 includes a face layer 84 of label material, a layer 85 of contact adhesive, and a backing layer 86. The layer 85 of contact adhesive permits layer 84 to be peeled apart from layer 86. In FIG. 14, label stock 151 is rectangular and includes a face layer 84 which ordinarily would, in use, be imprinted with alphanumeric characters or other desired inscriptions. In normal use of label stock 151, contact adhesive 85 adheres to layer 84 when layer 84 is peeled apart from backing layer 86 and, adhesive 85 is used to secure the face layer 84 to another piece of paper or to another desired surface after layer 84 and adhesive 85 are peeled apart from backing layer 86.

The conventional label stock 151 is attached to the bottom surface of substrate 82 with adhesive 83 which secures the upper surface of layer 60 to the bottom surface of substrate 82 when layer 84 is pressed against surface 55 in the manner shown in FIG. 14. The layer of adhesive 83 is normally between substrate 82 and face layer 84 and is coextensive with layer 84. The adhesive preferably, although not necessarily, permanently affixes layer 83 to layer 82.

In addition to label stock 151, label stock 152 is utilized in conjunction with substrate 82 to form label 94. Label stock 152 includes a face layer 89 of label material, a layer 90 of contact adhesive, and a backing layer 88. The layer 90 of contact adhesive permits layer 89 to be peeled apart from layer 88. In FIG. 14, label stock 151 is rectangular and includes a surface 95 on face layer 89 which ordinarily would, in use, be imprinted with alphanumeric characters or other desired inscriptions. In normal use of label stock 152, contact adhesive 90 adheres to layer 88 when layer 89 is peeled apart from backing layer 88 and, adhesive 90 is used to secure the face layer 89 to another piece of paper or to another desired surface after layer 89 and adhesive 90 are peeled apart from backing layer 88.

The conventional label stock 152 is attached to the top surface of substrate 82 with adhesive 87 which secures the upper surface of layer 82 to the bottom surface of substrate 88 when layer 88 is pressed against layer 82 in the manner shown in FIG. 14. The layer of adhesive 87 is normally between substrate 82 and backing layer 88 and is coextensive with layer 88. The adhesive preferably, although not necessarily, permanently affixes layer 88 to layer 82.

After layers 88 and 84 are adhesively permanently secured to substrate 82 by adhesive layers 87 and 83 in the manner shown in FIG. 14, the substrate 82, layers 84 and 88, and adhesive layers 83, 85, 87 are die cut through along continuous peripheral surface 91, respectively, to form a multi-layer label 94 which is peelable from layer 86 and form 11 in the direction of arrow F. Layer 86 ordinarily is not die cut through.

Label 94 includes rectangular layer 89, rectangular adhesive layer 90, rectangular layer 88A cut from layer 88, rectangular layer 82A cut from substrate 82, rectangular adhesive layer 83A cut from adhesive layer 83, rectangular layer 84A cut from layer 84, and rectangular adhesive layer 85A cut from the adhesive layer 85. Layer 89 also has an upper surface 95 having left hand portion 95A and right hand portion 95B. Alphanumeric characters 97 (i.e., "BOONE 0240183") are imprinted or formed on portion 95A and alphanumeric characters 96 ("AZ") are formed on portion 95B. A line of weakening, for example a perforated line, 92 is formed through layers 89, 90, 88A, 87A, 82A, 83A, 84A, 85A to facilitate the folding of label 94 in the manner illustrated in FIGS. 15 to 17.

After label 94 is peeled off of backing layer 86 and separated from business form or substrate 82 11, label 54 can, due to adhesive carried on the bottom 61A of layer 62, be secured to an ancillary piece of paper, a shipping container, or any other desired article. When label 54 is peeled off of liner layer 59, liner layer 59 and remaining portions of face layer 60 remain affixed to substrate 12 in the manner illustrated in FIGS. 4 and 5.

Figure 15:
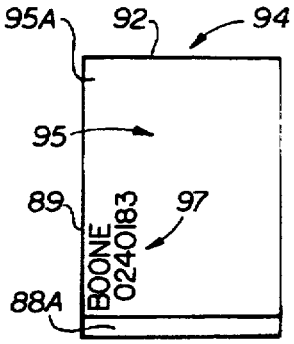
FIG. 15 is a side view illustrating a card produced by folding in half the label of FIG. 14.
Figure 16:
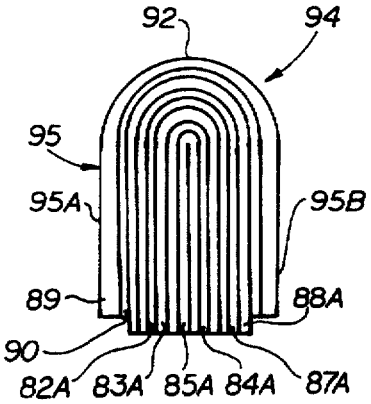
FIG. 16 is a front view further illustrating the card of FIG. 15.
Figure 17:
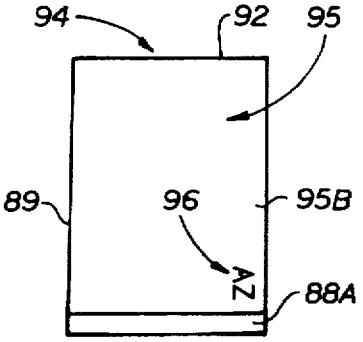
FIG. 17 is a side view further illustrating the card of FIG. 16.

After label 54 is peeled off of liner layer 59 and separated from business form 11, label 94 can also, due to the adhesive layer 85A carried on the bottom of layer 84A, be folded in half along line of weakening 92 into the configuration shown in FIGS. 15, 16, 17. In FIGS. 11 to 13, the adhesive layers 85A on the bottom of layer 84A secures both halves of label 94 together when the label 94 is folded along line of weakening 92 such that each half of label 94A is pressed against the other half to take on the configuration shown in FIGS. 15 to 17.

The card or laminate illustrated in FIGS. 15 to 17 is advantageous because the alphanumeric characters 97, 96 or other information or data or illustrations appearing on the "front" surface 95A and "back" surface 95B of the card can be pre-printed or otherwise formed on surface 95 of layer 89 prior to attaching label material 152 to substrate 82 and peeling label 54 from the substrate 82 in the manner illustrated in FIG. 14. Consequently, a card or other laminate can be formed without requiring a first printing pass to imprint the front of the card and requiring a second printing pass to imprint the back of the card.

Figure 18:
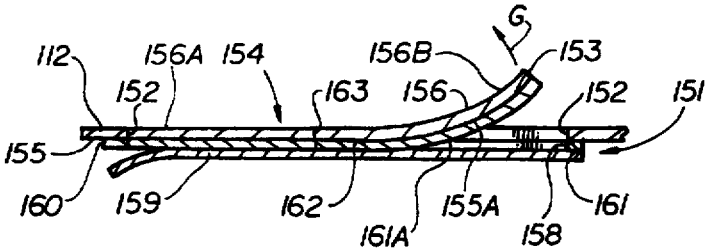
FIG. 18 is a side section view illustrating another embodiment of the invention.

A removable label 154 formed in substrate or business form 112 in accordance with one embodiment of the invention is illustrated in FIG. 18. Transfer tape 151 is utilized in conjunction with substrate 112 to form label 154. In FIG. 18, tape 151 is rectangular and includes an contact adhesive layer 160 and backing layer 159.

Adhesive layer 160 secures transfer tape 151 to the bottom surface 155 of substrate 112 when tape 151 is pressed against surface 155 in the manner shown in FIG. 18. After tape 151 is adhesively secured to substrate 112, the substrate 112 and layer 160 are die cut through along continuous peripheral surfaces 152 and 158, respectively, to form a bi-layer label 154 which is peelable from layer 159 and form 112 in the direction of arrow G. Label 154 includes rectangular layer 156 cut from substrate 112 and rectangular adhesive backing layer 162 cut from the adhesive layer 160 of label stock 151. Layer 156 has a bottom surface 155A which comprises a portion of the total area of the bottom surface 155 of substrate 112. Layer 156 also has an upper surface having left hand portion 156A and right hand portion 156B. Alphanumeric characters 175 (i.e., "TRADE PRINTERS 0761145") are imprinted or formed on portion 156A, and alphanumeric characters 176 ("AZ") are formed on portion 156B. A line of weakening, for example a perforated line, 163 is formed through layers 156 and 162 to facilitate the folding of label 154 in the manner illustrated in FIGS. 19 to 21.

Adhesive layer 162 has a bottom surface 161A which comprises a portion of the total area of the bottom surface 161 of the layer 160. Layer 156 is secured to layer 162. Backing layer 159 ordinarily is not cut through.

After label 154 is peeled off of backing layer 159 and separated from substrate or business form 112, label 154 can, due to adhesive layer 162, be secured to an ancillary piece of paper, a shipping container, or any other desired article. When label 154 is peeled off of backing layer 59, backing layer 159 and remaining portions of adhesive layer 160 remain affixed to substrate 112 in the manner illustrated in FIG. 18.

Figure 19:
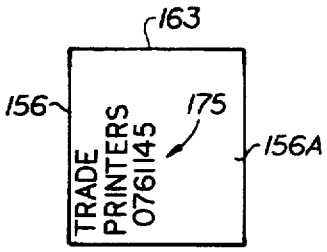
FIG. 19 is a side view illustrating a card produced by folding in half the label of FIG. 18.
Figure 20:
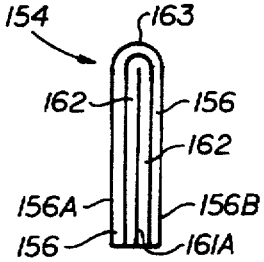
FIG. 20 is a front view further illustrating the card of FIG. 19.
Figure 21:
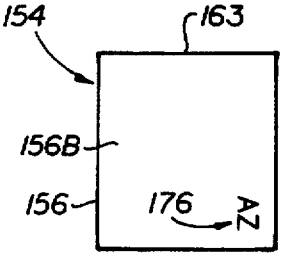
FIG. 21 is a side view further illustrating the card of FIG. 20.

After label 154 is peeled off of backing layer 159 and separated from substrate 112, label 154 can also, due to the adhesive layer 162, be folded in half along line of weakening 163 into the configuration shown in FIGS. 19 to 21. In FIGS. 19 to 21, the adhesive layer 162 on the bottom of layer 156 secures both halves of label 154 together when the label 154 is folded along line of weakening 163 such that each half of layer 162 is pressed against the other half to take on the configuration shown in FIGS. 19 to 21.

The card or laminate illustrated in FIGS. 19 to 21 is advantageous because the alphanumeric characters 175, 176 or other information or data or illustrations appearing on the "front" surface 156A and "back" surface 156B of the card can be pre-printed or otherwise formed on a business form or substrate 112 prior to peeling label 154 from the form in the manner illustrated in FIG. 18. Consequently, a card or other laminate can be formed without requiring a first printing pass to imprint the front of the card and requiring a second printing pass to imprint the back of the card.

The thickness of the layers of label stock, adhesive, and/or substrates or business forms utilized in the practice of the invention can vary as desired, as can the shape and dimension of the layers of label stock, the adhesive(s), and/or the business form(s).

The lines of weakening 63, 92, 163 can consist of perforations extending through one or more layers of a label 54, 94, 154, can be dashed or solid lines simply imprinted or marks on the surface of a label layer 56, 89, or 156, or can be any other means for indicating the line along which a label 54, 94, 154 is to be folded into a card.

As used herein, the term paper refers to paper produced from wood, cloth, or other materials and refers to any sheet material, including plastic, which can be inscribed or imprinted or serve as a layer of material in the business form of the invention.

As used herein, the term adhesive refers to glue, cement, electrostatic adhesion, or any other material used to adhere one layer of paper to another layer of paper. The adhesive may completely or partially cover a layer of material.

Figure 22:
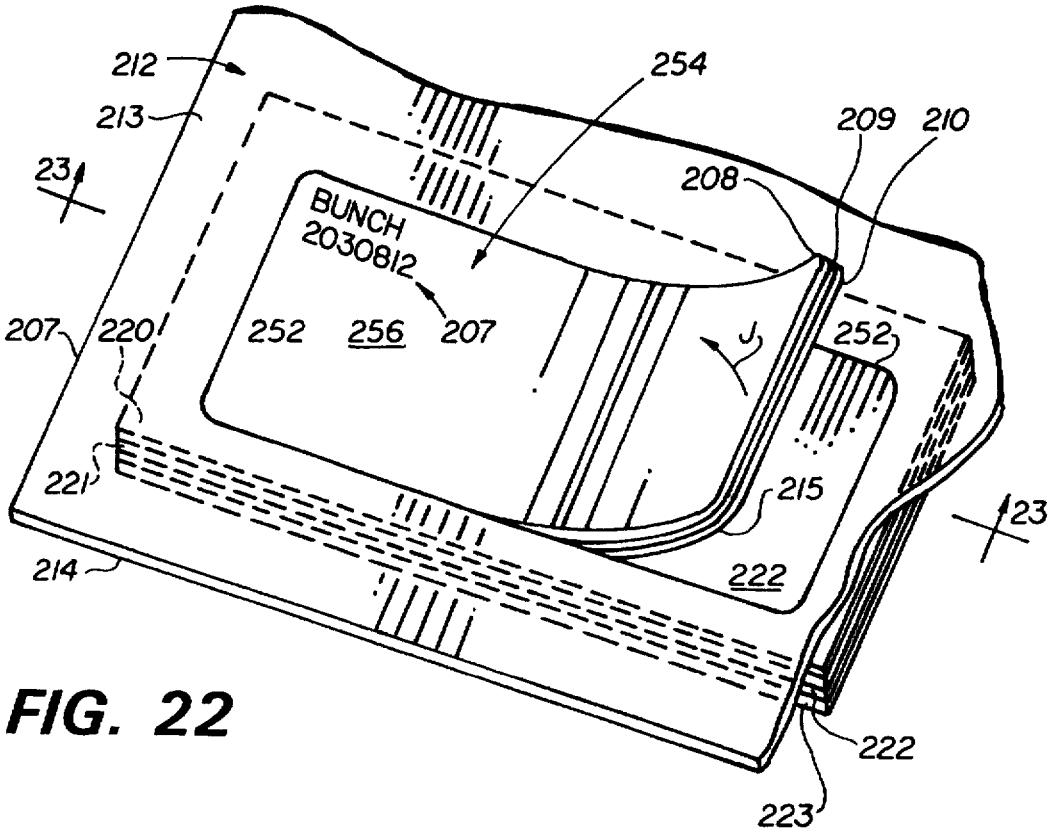
FIG. 22 is a perspective view illustrating a laminate card formed in accordance with an alternate embodiment of the invention.
Figure 23:
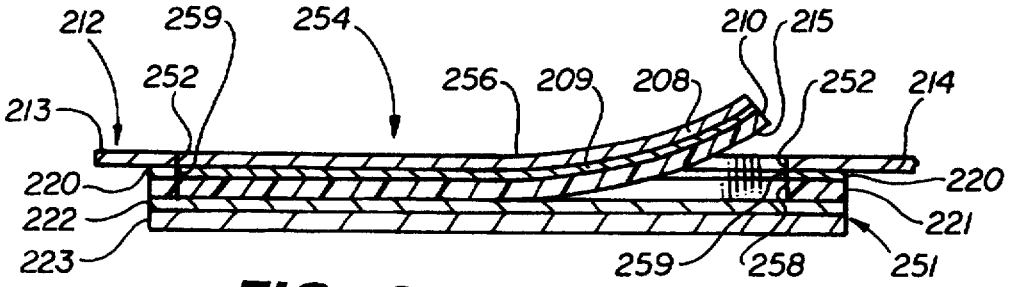
FIG. 23 is a side section view further illustrating the laminate card of FIG. 22 and taken along section line 23—23 thereof.

A removable laminate card 254 formed in substrate or business form 212 in accordance with another embodiment of the invention is illustrated in FIGS. 22 and 23. A thin layer of plastic 221, preferably transparent plastic or other transparent material, is secured to the back 214 of substrate 212 by a layer 220 of adhesive. Alphanumeric indicia or other symbols or pictorial representations can be printed on, formed on, or secured to back 214 prior to the application of layers 220 and 221 to back 214. A layer of backing material 223 is secured to plastic layer 221 by adhesive layer 222. Layers 222 and 223 comprise backing laminate 251. Substrate 212 and layers 209 and 210 are die cut through along continuous peripheral surfaces 252, 259, 258, respectively, to form a tri-layer label 254 which is peelable from layer 222 and from form 212 in the direction of arrow J. Label 254 includes rectangular layer 208 cut from substrate 212, rectangular adhesive layer 209 cut from the adhesive layer 220, and rectangular layer 210 of plastic cut from plastic layer 221. Layer 210 has a bottom surface 215 which comprises a portion of the total area of the bottom surface of layer 221. Layer 208 also has an upper surface 256 having alphanumeric characters 207 (i.e., "BUNCH 2030812") imprinted or formed thereon. Alphanumeric or other characters, symbols, or pictorial information is imprinted or formed in surface 256 before or after layers 220, 221, 222, and/or 223 are affixed to substrate 212.

The area or size of adhesive layer 209 comprises only a portion of the total area or size of the layer 220. Layer 210 comprises a central portion of layer 221. Layers 220 to 223 each presently preferably, but not necessarily, cover only a portion of the bottom surface 214 and are each preferably, but not necessarily, spaced away from the peripheral edges 207 of substrate 212. If desired, layers 222 and 223 can extend outwardly over the peripheral edges of layer 220 and 221 and can adhere to portions of bottom 214 which are adjacent to and extend outwardly from layer 220. Or, the peripheral edges of layers 222 and 223 can be spaced inwardly away from the peripheral edge of layer 221, i.e., layers 222 and 223 can be smaller than layer 221 such that the peripheral edges of layers 222 and 223 lie within the peripheral edges of layer 221, provided, however, that the continuous peripheral surfaces 252, 259, 258 lie within the peripheral edges of layers 222 and 223. Similarly, layers 220 and 221 can be smaller than layer 222 such that the peripheral edges of layers 220 and 221 lie within the peripheral edges of layer 222, provided, however, that the continuous peripheral surfaces 252, 259, 258 lie within the peripheral edges of layers 220 and 221.

After laminate card 254 is peeled off of adhesive layer 222 and separated from substrate or business form 212, card 254 can be carried on the person, in a wallet, in a purse, etc. When card 254 is peeled off of backing layer 223, it is presently preferred that adhesive layer 222 remain affixed to layer 223 in the manner illustrated in FIGS. 22 and 23. If desired, when card 254 is peeled off of backing layer 223, a portion of layer 222 can adhere to the bottom 215 of layer 210 and separate from layer 223 such that the adhesive on bottom 215 can be utilized to affix card 254 to another surface.

By way of example, and not limitation, layer 210 presently comprises a layer of low density polyethylene which is about 0.001 to 0.002 inches thick; and, substrate 212 is presently preferably a layer of paper which is 0.003 to 0.012 inches thick.

As used herein, the term "imprint" or "imprinting" means to print or otherwise form alphanumeric characters or other symbols or to form pictorial images or representations on a piece of material. Consequently, writing or typing or printing a word or number on a piece of material constitutes imprinting the material; painting or printing a picture on a piece of material comprises imprinting the material; attaching a photographic image to the material comprises imprinting the material, etc.

In one embodiment of the invention, the backing laminate layer 223 comprises a sheet of thin, compressible, elastic, pliable polymer material like 0.002 inch thick polyethylene. Such a compressible, elastic polymer sheet is preferred because many backing materials have a layer 223 which is hard and brittle. The elastic, compressible polymer sheet utilized in the practice of the invention will, although thin, resiliently deform during die cutting so that the risk that the backing layer 223 will be cut through is reduced. The layer 223 is 0.001 inch to 0.006 inch thick, preferably 0.002 to 0.003 inch thick. The layer of adhesive 222 utilized in conjunction with the layer 223 is preferably of minimal bonding strength and is typically in the range of 0.5 ounce to 16 ounce adhesive. By way of example, thin polyethylene liners each coated with an adhesive having a designated bonding strength are marketed under the trademark PRO-TEC RITE by American Built Rite, Moorestown, N.J. 08057. Two such polyethylene liners are marketed by American Built Rite as Product Nos. 7301 and 7302. Another source for such a product (Cataloge No. MFC 85) is the company Main Tape of Plymouth, Wis. (Telephone 1-800-858-0481). In one embodiment of the invention, in FIGS. 22 and 23 layers 220 and 221 are eliminated and a thin, elastic, compressible, pliable layer 223 of polyethylene (0.001 to 0.006 inch thick) is applied directly to the back 214 of substrate 212 by a weak layer (0.5 ounch to sixteen ounce) 222 of adhesive which contacts back 214 and layer 223. Layers 212 and 222 are then die cut to form layers 208 and 209 such that layers 208 and 209 can be peeled off of the thin, elastic layer 223 of polyethylene. The substrate 212 can be any desired material having any desired physical properties. Plastic and paper materials are presently preferred. In one presently preferred configuration, substrate 212 comprises a relatively heavy material such as twenty-eight pound ledger stock, thirty-two pound ledger stock, or one hundred pound card stock. Then when card or die cut panel 254 is peeled off of layers 222 and 223, the heavier weight of the stock comprising the resulting card 254 give the card strength and rigidity. The adhesive in layer 222 is selected such that substantially all of the adhesive intermediate panel 254 and layer 223 adheres to layer 223 and not to die cut panel 254 when panel 254 is peeled off of layers 222 and 223. As used herein, "substantially all" of the adhesive adheres to panel layer 223 when there is no adhesive or only small amounts of adhesive on panel 254 such that panel 254 can be handled and used without sticking to other surfaces placed adjacent or against panel 254.

Substrate 212 (or an outer layer of substrate 212 if substrate 212 is a laminate) and/or layer 221 can comprise an imprintable polymer material. Such an imprintable polymer material can be imprintable by a dot matrix printer; for example, COPYCODE clear two mil thick polyester (Spec. Number 70414) manufactured by FASSON. The imprintable polymer material can be laser imprintable; for example, KASERCIDE 3492XL four mil thick flexible vinyl (Spec. Number 73367). Or, the imprintable polymer material can be thermally imprintable; for example, THERMAL TRANSFER PRINTER two mill thick clear printable polyester (Spec Number 72829).

Substrate 212, layer 221, and/or another layer adhered to the top surface 213 of substrate 212 can comprise a non-printable polymer material such as FASCAM polypropylene (Spec. Number 70836) or polyester (Spec. Number 70838) sold by FASSON. Similar products are sold by Sekisui Ta Industries, Inc. of 7089 Belgrave Avenue, Garden Grove Calif. 92641-2807 and by other suppliers.

Figure 24:
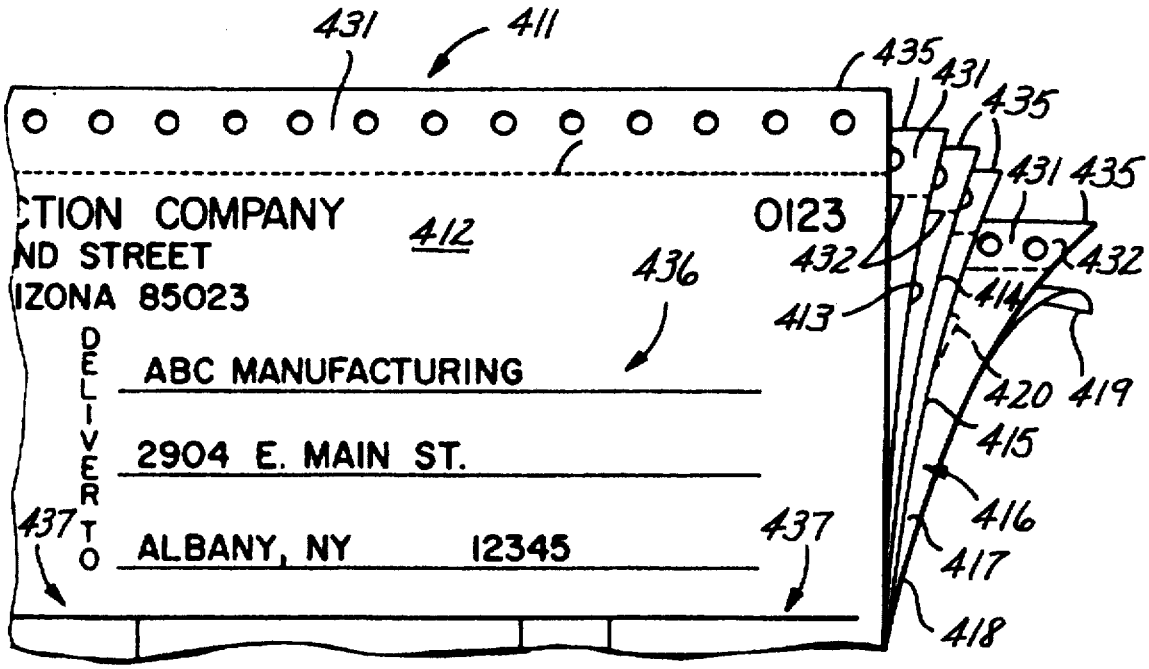
FIG. 24 is a perspective view of a conventional multiple sheet business form.

A conventional business form is illustrated in FIG. 24 and is generally indicated by reference character 411. Form 411 includes invoice copy sheet 412, office copy sheet 413, packing list sheet 414, salesman's copy 415, and packing label sheet 416. Sheet 416 includes paper sheet 417 having adhesive layer 418 on the entire back surface thereof. Sheet 419 of backing material protects the adhesive layer. Sheet 416 or backing 419 can, if desired, be die cut along a dashed line 420. Sheets 412–415, 417 can each be manufactured from a different color of paper so that a salesperson utilizing form 411 can distinguish the sheets from one another. Sheets 413–415, 417 are cut from a type of paper which forms a dark image when pressure is applied through sheet 412 and against sheets 413–415, 417. Instead of utilizing such pressure sensitive paper, sheets 412–415, 417 can be cut from ordinary sheets of paper and sheets of carbon can be interleaved between sheet pairs 412, 413; 414,415; and 415, 417. Thus, if either pressure sensitive paper or regular paper in combination with interleaved sheets of carbon paper is utilized, when a name and address is inscribed on the front page 412 of form 411 the name and address is reproduced on pages 413–415, 417 of the form. Form 411 can include one or more sheets on which it is not desired to reproduce the address inscribed on sheet 412. For example, to avoid forming the address on sheet 415, a carbon copy would be omitted from between sheets 414, 415 and sheet 415 would not be cut from pressure sensitive paper stock.

Top edge strips 431 of reach sheet 412 to 416 are glued or crimped together to form 411. Each sheet can be separated from form 411 along perforated line 432. In some business forms, perforation lines 432 are not provided and the sheets are simply peeled apart along top edge strips 431. This is particularly the case when the individual sheets are bound together like a paperback book by being glued with a rubber gun resin along upper edges 435. Sheets 412 to 416 are generally square or rectangular, of equal size, and are stacked so that the peripheral rectangular edge of each sheet generally corresponds with the edges of the other sheets.

In addition to the "Deliver To" address block shown in FIG. 24, business forms often include a separate block for inserting the name and address of a purchaser. Both the "Deliver To" address block and the purchaser address block, if there is one, are normally reproduced on sheets 413, 414, and 415 in the same general location as and directly beneath the address blocks on sheet 412. Thus, when an address block on sheet 412 is completed, either manually or with a machine, the address inscribed on sheet 412 is reproduced on sheets 413, 414, 415. In FIG. 24, sheet 417 of sheet 416 is cut from pressure sensitive paper and is large enough so that when the "ABC Manufacturing" address is inscribed in the "Deliver To" block 436 on sheet 412, the localized pressure bearing through sheet 412 and against sheets 413 to 415, 417 causes the "ABC Manufacturing" address to be reproduced with the address block on the front of sheet 17.

Figure 25:
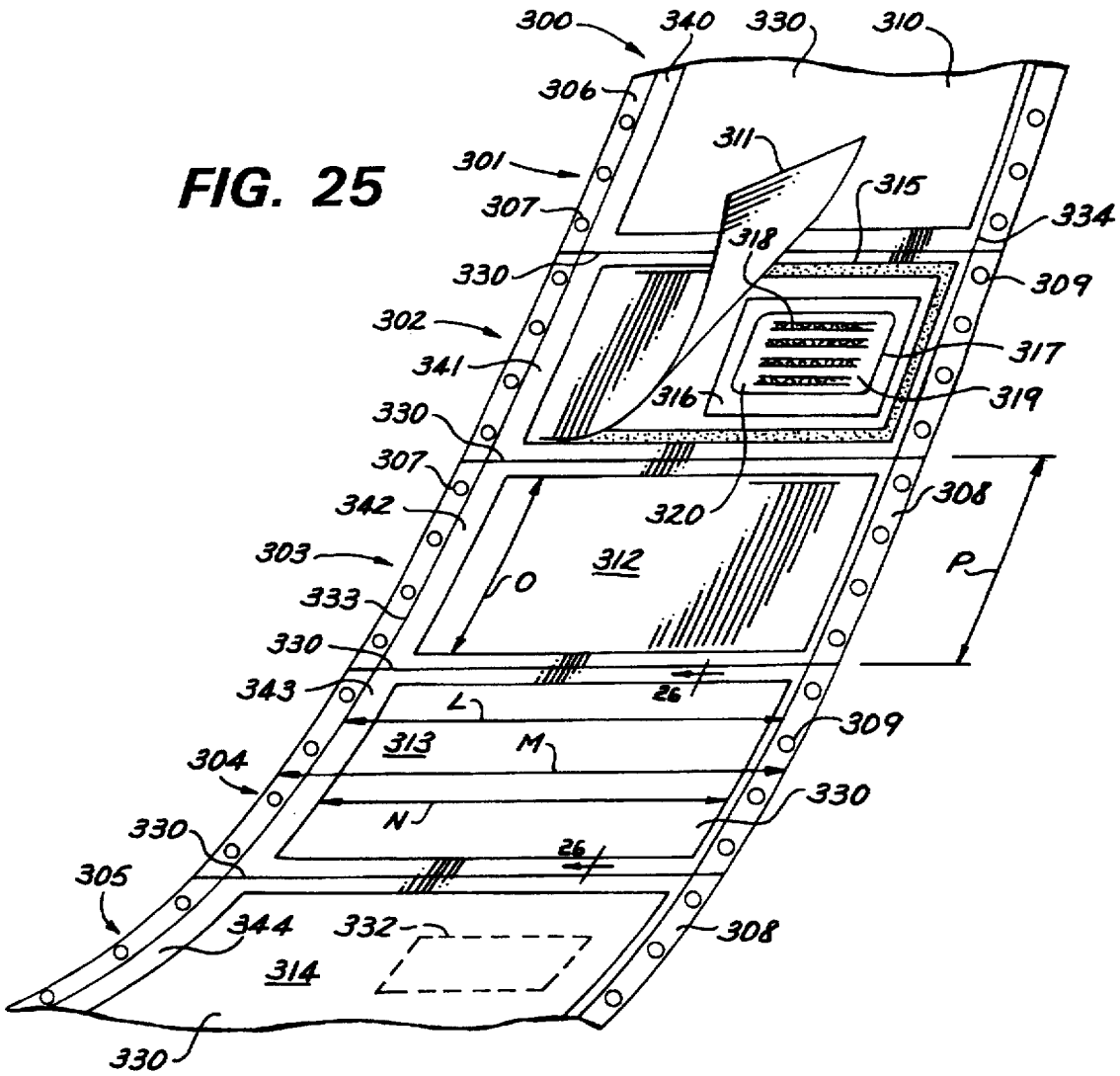
FIG. 25 is a perspective view of a strip of multiple sheet business forms constructed in accordance with the invention; and, FIG. 26 is section view of one of the business forms of FIG. 25 taken along section line 26—26 and further illustrating construction details thereof.
Figure 26:
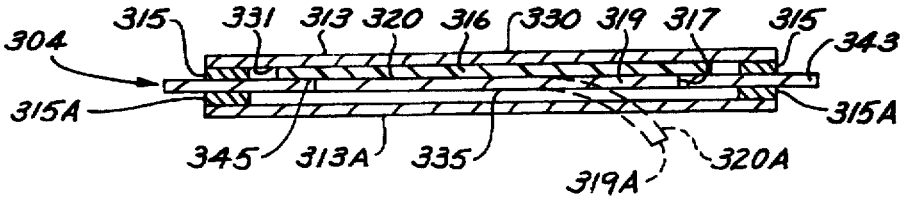

FIGS. 25 and 26 illustrate a strip 300 of multiple sheet business forms which is constructed in accordance with the invention. Strip 300 includes lines of perforation or weakening 300 spaced at equal intervals along strip 300. A strip 306 of paper extends along the left edge of strip 300 and is attached to each business form 301 to 305 along line of weakening 333. Apertures 307 are formed through strip 306. A strip 308 of paper extends along the right edge of strip 300 and is attached to each business form 301 to 305 along line of weakening 334. Apertures 309 are formed through strip 308. Each rectangular primary sheet 340, 341, 342, 343, 344 is bounded by a pair of lines of weakening 330 and by lines of weakening 333 and 334. Rectangular primary sheets 340–344 and strips 306 and 308 comprised a unitary strip of paper which was processed to form lines of weakening 330, 333, 334 and apertures 307 and 309 in the strip of paper.

A substantially rectangular die cut line 317 is formed in each primary sheet 340–344. The length of and contour inscribed by line 317 can vary as desired. Line 317 is, however, normally, but not necessarily, spaced apart from lines of weakening 330, 333, 334. Alphanumeric, pictorial, or other information is imprinted 318 or formed on the top surface 320 and/or on the bottom surface 335 of card-shaped member 319. The under surface 345 of transparent rectangular plastic sheet 316 is coated with adhesive which secures sheet 316 to surface 320 and to the portion of each primary sheet 340–344 which bounds die cut line 317. The adhesive permits surface 320 to be peeled apart from and off of sheet 316 such that the adhesive remains on sheet 316. Alternatively, if member 319 is to be used as a decal, then member 319, sheet 316 and the adhesive therebetween can be produced such that the adhesive adheres to surface 320 when member 319 is peeled apart from sheet 316. In any event, when member 319 is peeled off of sheet 316, the peripheral edges of sheet 316 remain secured to primary sheet 340, 341, 342, 343, or 344, as the case may be.

Instead of or in addition to member 319, sheet 316, and die cut line 317, a sheet 340 to 344 can be provided with one of the labeling systems illustrated in FIGS. 1 to 13, 14 to 23 herein, can be provided with any other desired label system, or can be imprinted or provided with pictorial material in any desired manner.

The label system, imprinting, etc. is, however, normally covered by a secondary sheet 310 to 314 of paper or other material and is normally circumscribed by the adhesive 315 or other means used to secure secondary sheet 310–314 in place on its associated primary sheet 340 to 344. Adhesive 315 can, if desired, permit a secondary sheet 310 to 314 to be readily peeled off of its associated primary sheet 340 to 344. Or, adhesive 315 can permanently secure a secondary sheet 310 to 314 in place on its associated primary sheet 340 to 344. A paper zipper or other area of weakening can be formed in a secondary sheet 310 to 314 to permit the ready opening of the secondary sheet.

Each primary sheet 340 to 344 has a height indicated by arrow P and a width indicated by arrow L. The width of strip 300, including the width of strips 306 and 308, is indicated by arrows M. The height of each secondary sheet 310 to 314 is indicated by arrow O and the width by arrow N. The width L of each sheet 340 to 344 is preferably, but not necessarily, greater than the width of each secondary sheet 310 to 314. The height P of each primary sheet 340 to 344 is greater than the height O of each secondary sheet 310 to 314. The lesser height of each secondary sheet 310 to 314 is important because it permits the secondary sheet 310 to 314 to be spaced apart from the lines of weakening so that strip 300 tends not to tear when strip 300 is folded in a zig-zag fashion or when strip 300 travels around a roller or platen in a printing press or other machine.

Each secondary sheet 310 to 314 can, after being glued or otherwise attached to its associated primary sheet 340 to 344, be imprinted or provided with pictorial or other information in any designated area, for example the area indicated by dashed lines 332 in FIG. 26. Secondary sheets 310 to 314 can also be imprinted or provided with other information prior to being fastened to its associated primary sheet 340 to 344. A plurality of secondary sheets can be attached to a primary sheet 340 to 344. When a plurality of secondary sheets are attached to a primary sheet, the secondary sheets can be stacked on or overlap one another, or can be separate from one another.

In FIG. 25, the secondary sheets 310 to 314 are each fastened to the top of its associated primary sheet. As indicated in FIG. 26, an adhesive strip 315A or other fastening means can be utilized to secure the periphery of a secondary sheet 313A to the back or underside of its associated primary sheet 343.

Instead of securing only a portion of a secondary sheet 310 to 314 to its associated primary sheet 340 to 344, the entire side of a secondary sheet can be secured to its associated primary sheet.

FIG. 26 further illustrates secondary sheets 313 and 313A secured to primary sheet 304 by adhesive strips 315, 315A, respectively. The undersurface 345 of member 316 is secured to top surface 320 of member 319 and to portions of sheet 304 immediately adjacent die cut line 317. The under side 331 of secondary sheet 313 contacts but ordinarily is not glued or fastened to member 316. Member 319 can be peeled off of member 316 in the manner indicated by dashed lines 319A. When member 319 is peeled off of member 316, surface 320 (indicated on member 319A by reference character 320A) separates from member 316.

Having described my invention in such terms as to enable those skilled in the art to understand and practice it, and having described the presently preferred embodiments thereof, I claim:

1. A strip of material comprising a plurality of business forms attached end-to-end along transverse parallel lines of weakening, each of said business forms comprising (a) a first leaf having a front side, a back side, a width, a height, an outer peripheral edge, and an imprinted die cut area lying within said outer peripheral edge;

(b) a second leaf having a front side, a back side, a width, a height, and an outer peripheral edge, the height of said second leaf being less than the height of said first leaf, said second leaf lying within said outer peripheral edge of said first leaf;

(c) means for releasibly securing at least a portion of the outer peripheral edge of said second leaf to the front side of said first leaf such that (i) the imprinted die cut area lies within said outer peripheral edge of said second leaf and is covered by said second leaf, and (ii) said second leaf can be peeled off said first leaf to expose the imprinted area;

(d) a third leaf having a front side, a back side, a width, a height and an outer peripheral edge, the height of said third leaf being less than the height of said first leaf, said third leaf lying within said outer peripheral edge of said first leaf; and, (e) means for releasibly securing at least a portion of the outer peripheral of said third leaf to the back side of said first leaf such that (i) the imprinted die cut area lies within said outer peripheral edge of said third leaf and is covered by said third leaf, and (ii) said third leaf can be peeled off said first leaf to expose the imprinted die cut area.

2. The strip of material of claim 1 further comprising (a) a fourth leaf having a front side, a back side, a width, a height, and an outer peripheral edge, the height of said fourth leaf being less than the height of said first leaf, the back side of said fourth leaf covering and facing the die cut area; and, (b) adhesive intermediate the back side of said fourth leaf and the die cut area and releasibly securing the die cut area to said fourth leaf.

3. The strip of material of claim 2 wherein the die cut area is a decal and the adhesive intermediate the die cut area and the back side of said fourth leaf adheres to the die cut area when the die cut area is peeled off said fourth leaf.

4. The strip of material of claim 2 wherein the die cut area is a label and the adhesive intermediate the die cut area and the back side of said fourth leaf adheres to the back side of said fourth leaf when the die cut area is peeled off said fourth leaf.

* * * * *